US006429393B1

(12) United States Patent
Opfer et al.

(10) Patent No.: US 6,429,393 B1
(45) Date of Patent: Aug. 6, 2002

(54) CURRENT TRANSFER ARRANGEMENT FOR CIRCUIT INTERRUPTER

(75) Inventors: John C. Opfer, Chicago; Henry W. Kowalyshen, Niles, both of IL (US)

(73) Assignee: S&C Electric Co., Chicago, IL (US)

( * ) Notice: Subject to any disclaimer, the term of this patent is extended or adjusted under 35 U.S.C. 154(b) by 0 days.

(21) Appl. No.: 09/705,321

(22) Filed: Nov. 3, 2000

Related U.S. Application Data

(60) Provisional application No. 60/165,414, filed on Nov. 13, 1999.

(51) Int. Cl.[7] ..... H01H 33/70

(52) U.S. Cl. ..... 218/68; 218/155; 218/43

(58) Field of Search ..... 218/1–7, 43–45, 218/14, 49–50, 65, 68, 78, 84, 153, 154, 118, 120, 140

(56) References Cited

U.S. PATENT DOCUMENTS

| | | | | | |
|---|---|---|---|---|---|
| 2,979,591 | A | * | 4/1961 | Friedrich | 218/154 |
| 4,983,792 | A | * | 1/1991 | Rogers et al. | 218/7 |
| 5,668,360 | A | * | 9/1997 | Perret et al. | 218/5 |
| 5,780,799 | A | * | 7/1998 | Friedrich | 218/57 |

* cited by examiner

*Primary Examiner*—Lincoln Donovan
(74) *Attorney, Agent, or Firm*—James V. Lapacek

(57) ABSTRACT

A current transfer arrangement is provided for a circuit interrupter that provides support for the contacts of the circuit interrupter and also provides current transfer between the contacts of the circuit interrupter and the external circuit terminal connection points directly through the end flanges/fittings thereof. The current transfer arrangement includes a first member assembled onto each of the circuit interrupter contacts and clamping members for securing the first member to the end flange. The end flanges include receiving grooves cooperating with the first member.

7 Claims, 5 Drawing Sheets

CURRENT TRANSFER ARRANGEMENT FOR CIRCUIT INTERRUPTER

This application claims the benefit of U.S. Provisional Application No. 60/165,414 filed on Nov. 13, 1999.

BACKGROUND OF THE INVENTION

1. Field of the Invention

The present invention relates generally to the field of protective devices and systems for electrical power transmission and distribution systems, and more particularly to a current transfer arrangement for a circuit interrupter that provides support for the contacts of the circuit interrupter and also provides current transfer between the contacts of the circuit interrupter and the external circuit terminal connection points directly through the end flanges/fittings thereof.

2. Description of the Related Art

Various electrical connection arrangements are know for connecting the contacts of protective devices such as fuses, circuit interrupters and circuit breakers to the electrical circuit terminals of electrical power transmission and distribution systems. Typically, these arrangements involve the end closures of gas-tight enclosures.

While the prior art arrangements may be useful to provide electrical connections, these prior arrangements are generally complex and require a number of rather specialized components and may also prove difficult to assemble.

SUMMARY OF THE INVENTION

Accordingly, it is a principal object of the present invention to provide a current transfer arrangement for a circuit interrupter that provides support for the contacts of the circuit interrupter and also provides current transfer between the contacts of the circuit interrupter and the external circuit terminal connection points directly through the end flanges/fittings thereof.

It is another object of the present invention to provide a current transfer arrangement for a circuit interrupter that utilizes a minimum number of simple components.

These and other objects of the present invention are efficiently achieved by the provision of a current transfer arrangement for a circuit interrupter that provides support for the contacts of the circuit interrupter and also provides current transfer between the contacts of the circuit interrupter and the external circuit terminal connection points directly through the end flanges/fittings thereof. The current transfer arrangement includes a first member assembled onto each of the circuit interrupter contacts and clamping members for securing the first member to the end flange. The end flanges include receiving grooves cooperating with the first member.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
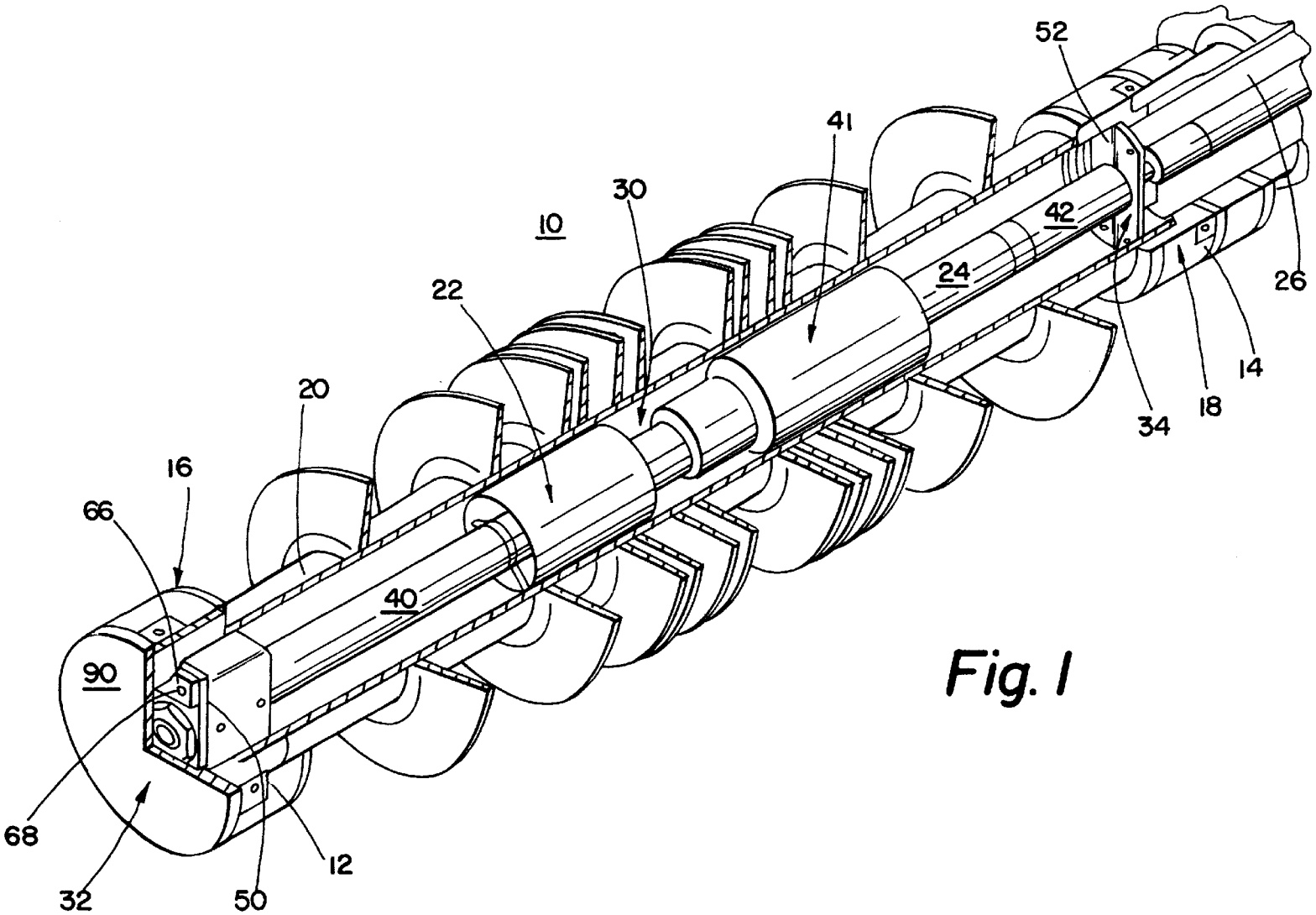
FIG. 1 is a perspective view of a circuit interrupter with parts cut away for clarity and illustrating the current transfer arrangement in accordance with the present invention.
Figure 2:
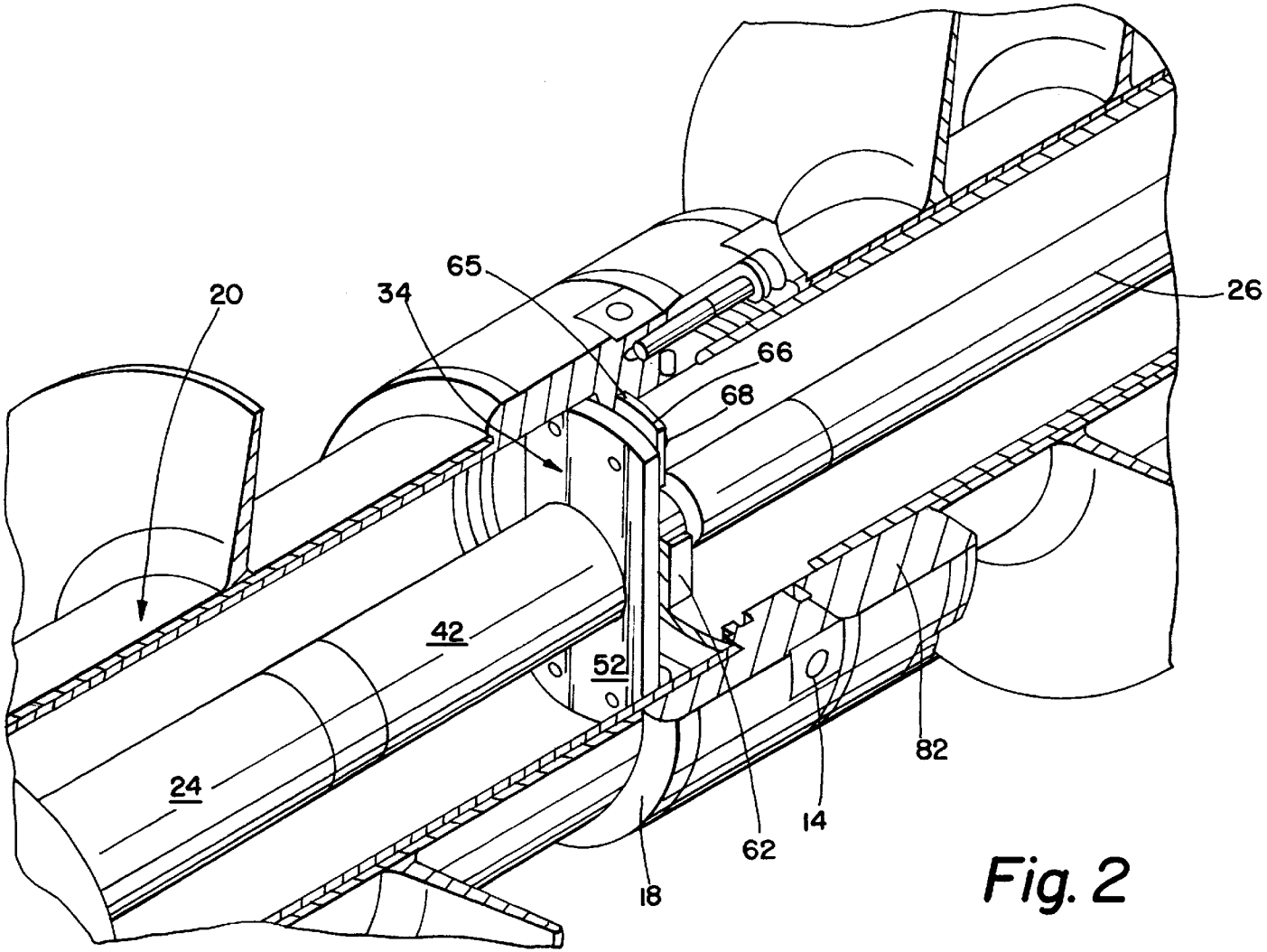
FIG. 2 is an enlarged perspective view of the circuit interrupter of FIG. 1.
Figure 3:
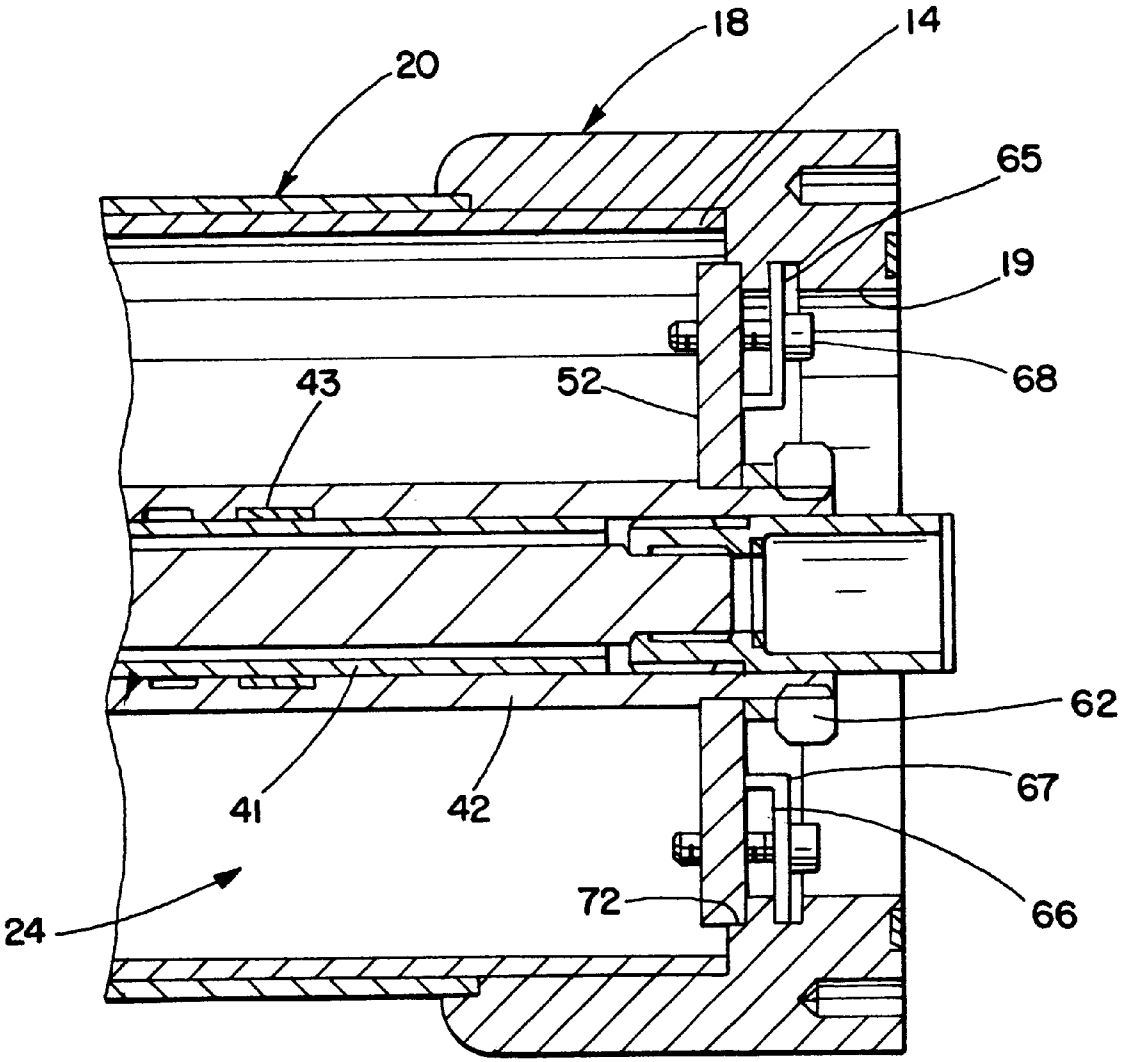
FIGS. 3 and 4 are respective partial front elevational views, partly in section, of bottom and top ends respectively of the circuit interrupter of FIG. 1.
Figure 4:
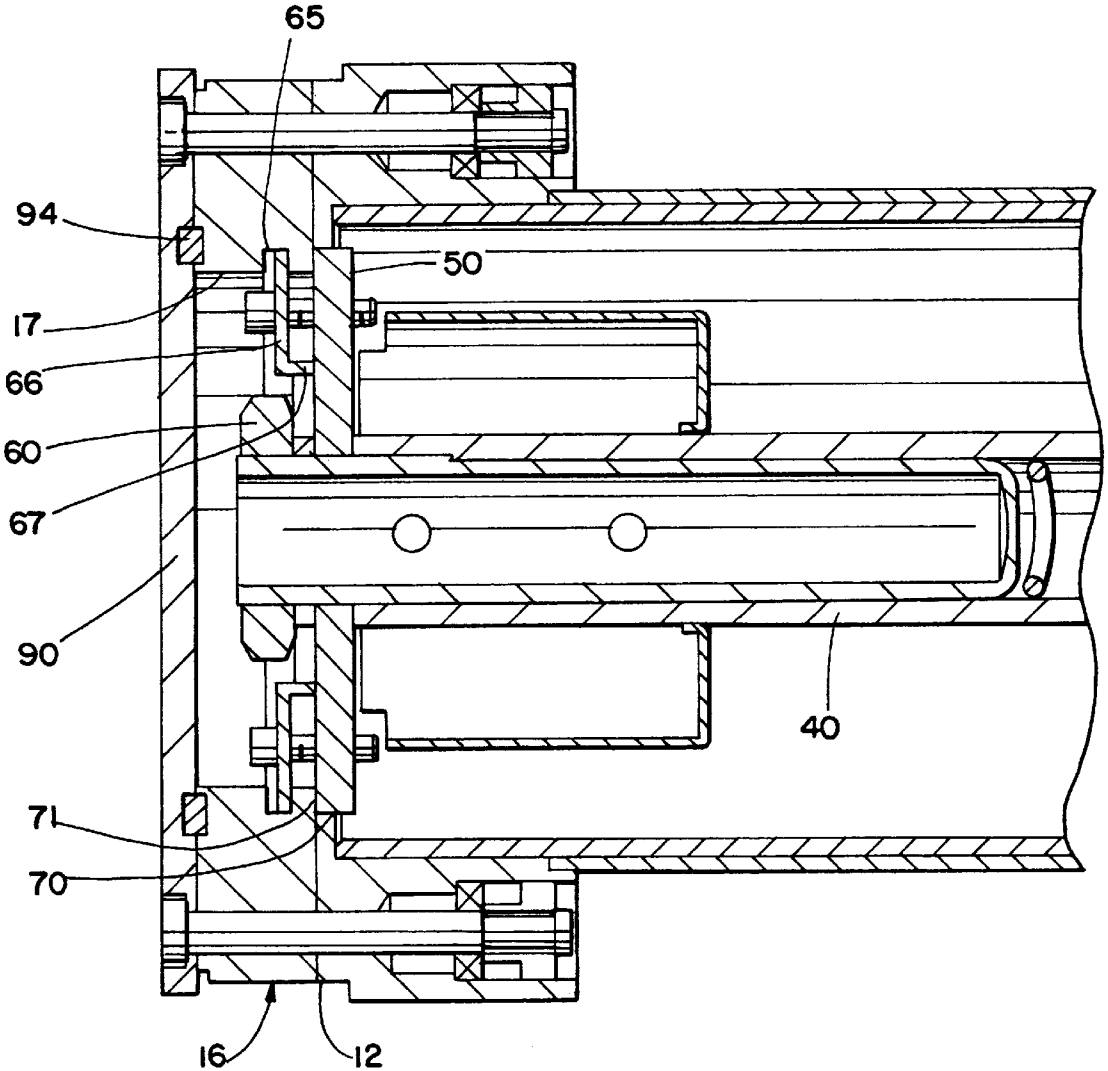

Referring now to FIGS. 1 and 2, a circuit interrupter 10 including the current transfer arrangement of the present invention provides electrical connection to power system circuit terminals at connection points 12, 14, at the top and bottom respectively of the circuit interrupter. The connection points 12, 14 are provided on respective end flanges 16, 18 carried by a housing 20 of the circuit interrupter 10. The end flanges 16, 18 are affixed to the housing 20 during fabrication thereof. The circuit interrupter includes upper and lower current carrying contact structures 22, 24 respectively that are relatively movable to open and close the circuit interrupter and thus make and break the electrical connection between the connection points 12, 14. In the illustrative circuit interrupter 10 of FIG. 1, the lower contact structure 24 is movable via an operating rod 26 so as to define an open gap at 30 when the circuit interrupter 10 is open. Specifically, the lower contact structure 24 includes a movable contact member 41 that is movable via the operating rod 26 and a fixed contact member 42 that supports and transfers current at 43 to the movable contact member 41 that moves within the fixed contact member 42. For example, a flexible contact arrangement is provided at 43 between the relatively movable contact members 41, 42.

The current transfer arrangement of the present invention is utilized at 32, 34 to respectively connect an upper contact member 40 of the upper contact structure 22 to the circuit connection point 12 and the lower contact member 42 of the lower contact structure 24 to the circuit connection point 14.

Figure 5:
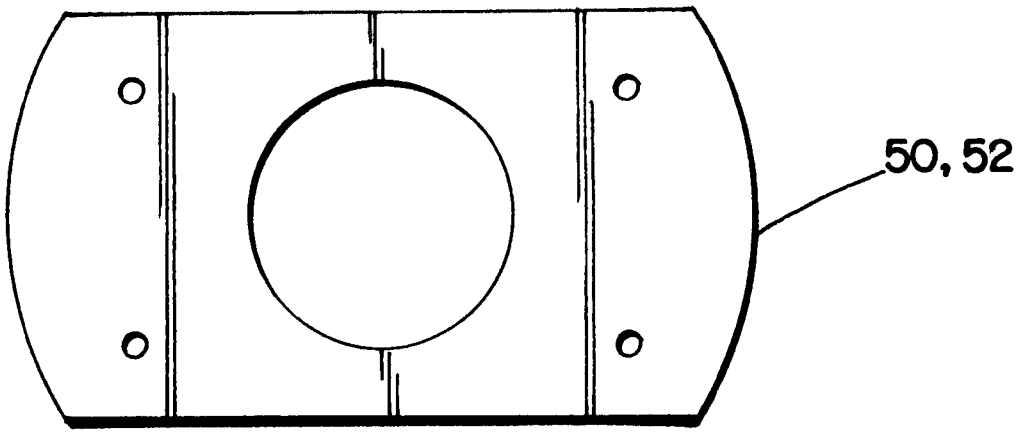
FIG. 5 is an elevational view of a contact support/current transfer member of the current transfer arrangement of FIGS. 1–4.

Specifically, and referring now additionally to FIG. 5, the current transfer arrangement includes a contact support/current transfer member 50 at 32 to support the upper contact structure 22 and transfer current through the upper contact member 40 to the upper flange 16. Similarly, the current transfer arrangement includes a contact support/current transfer member 52 at 34 to support the lower contact structure 24 and transfer current through the lower contact member 42 to the lower flange 18. The ends of the upper and lower contact members 40, 42 are threaded and cooperate with respective retaining nuts 60, 62 to secure the respective upper and lower contact support/current transfer members 50, 52 to the upper and lower contact members 40, 42 respectively.

Figure 6:
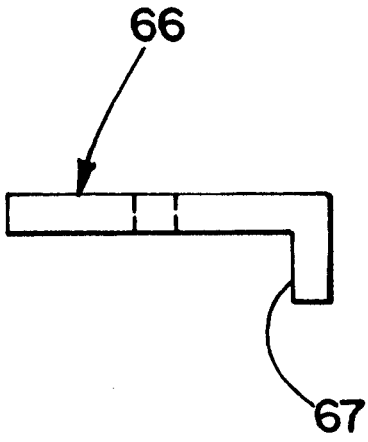
FIG. 6 is an elevational view of a retainer clip member of the current transfer arrangement of FIGS. 1–4.

With additional reference now to FIG. 6, retainer clip members 66 are provided along with fasteners at 68 to secure the upper and lower contact support/current transfer members 50, 52 to the respective end flanges 16, 18, e.g. one retainer clip members 66 on either end of the members 50, 52. The retainer clip members may also be characterized as clamp members. Specifically, the retainer clip members 66 at one end are received within a groove 65 of the end flanges 16, 18 and the fasteners 68 clamp the retainer clip members to the members 50, 52 that are received within grooves 70, 72 respectively in the respective end flanges 16, 18. The retainer clip members 66 include an upwardly turned edge 67 (best seen in FIG. 6) that contacts the contact support/current transfer members 50, 52. As will be apparent to those skilled in the art, the contact support/current transfer members 50, 52 and the end flanges 16, 18 are conductive or at least are conductive in the areas of interface in the current path.

In the illustrative circuit interrupter 10, the lower end flange 18 and the lower contact arrangement 24 interface to an insulating support column 80 including an end flange 82. Thus the central opening 19 of the lower end flange 18 communicates with and is connected to the end flange 82 of the insulating support column 80, e.g. to provide a sealed environment therebetween.

At the upper end of the circuit interrupter 10, an end plate 90 is secured to the upper end flange 16 via fasteners 92 and a seal element 94 disposed between the upper end flange 16 and the end plate 90. Thus, it can be seen that the current transfer arrangement of the present invention is independent of the end closure of the housing 20 and is accomplished without involving passage through any gas-tight enclosure. Accordingly, the end plate 90 need not be conductive and can instead actually be insulating.

Considering now the assembling of the current transfer arrangement, at the upper end flange 16, the member 50 is inserted on an angle through the central opening 17 and placed into the receiving groove 70 against a shoulder 71 of the groove 70. Then, the retainer clip members 66 are positioned and fastened to clamp the member 50 against the retainer clip member 66. Next, the contact member 40 is assembled to the member 50 via the retaining nut 60, thus securing and supporting the upper contact structure 22 and also providing a current transfer path for the upper contact structure 22 to the terminal connection point 12 on the upper end flange 16 through the member 50.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed is:

1. A current transfer arrangement for a circuit interrupter that has first and second contact members that are relatively movable and an elongated housing with first and second ends and a conductive end flange at each of the first and second ends, each of the end flanges having a central opening and a circumferential flange surface, the current transfer arrangement comprising:

a first member being affixed to each of the first and second contact members; and first means for securing each of said first members to the respective circumferential flange surface of the end flange within the central opening thereof, said first means comprising a first receiving groove formed within the central opening of the end flange arranged to receive said first member, a clamp member, second means formed within the central opening of the end flange for cooperating to retain the clamp member and third means for securing said clamp member to said first member.

2. The current transfer arrangement of claim 1 wherein the first and second contact members each comprise a threaded end and a retaining nut for affixing said first member via threading onto the threaded end.

3. The current transfer arrangement of claim 1 wherein said first member is planar.

4. The current transfer arrangement of claim 1 wherein said end flange is cylindrical.

5. The current transfer arrangement of claim 1 further comprising a second member for cooperating with at least one of the conductive end flanges for providing an end closure for the elongated housing.

6. The current transfer arrangement of claim 5 wherein said second member is non-conductive.

7. A current transfer arrangement for a circuit interrupter that has first and second contact members that are relatively movable and an elongated housing with conductive end flanges at either end thereof, the end flanges having central openings, the current transfer arrangement comprising:

a first member being affixed to each of the first and second contact members; and first means for securing each of said first members to the respective end flange within the central opening thereof, said first means comprising a first receiving groove formed within the central opening of the end flange arranged to receive said first member, a clamp member, second means formed within the central opening of the end flange for cooperating to retain the clamp member and third means for securing said clamp member to said first member.

* * * * *